US007901244B2

(12) United States Patent
Lee et al.

(10) Patent No.: US 7,901,244 B2
(45) Date of Patent: Mar. 8, 2011

(54) STACKED ELECTRICAL CONNECTOR

(75) Inventors: Hsin-Le Lee, Taipei (TW); Hao-Tser Tsai, Taipei (TW); Ruei-Chin Wu, Taipei (TW); Shr-Da Mai, Taipei (TW)

(73) Assignee: Pegatron Corporation, Taipei (TW)

( * ) Notice: Subject to any disclaimer, the term of this patent is extended or adjusted under 35 U.S.C. 154(b) by 0 days.

(21) Appl. No.: 12/536,118

(22) Filed: Aug. 5, 2009

(65) Prior Publication Data

US 2010/0035466 A1 Feb. 11, 2010

(30) Foreign Application Priority Data

Aug. 6, 2008 (TW) ..... 97129797 A

(51) Int. Cl.
*H01R 13/60* (2006.01)

(52) U.S. Cl. ..... 439/541.5; 439/607.25

(58) Field of Classification Search ..... 439/541.5, 439/540.1, 607.4, 607.25, 607.35, 607.55
See application file for complete search history.

(56) References Cited

U.S. PATENT DOCUMENTS

| | | | | |
|---|---|---|---|---|
| 5,167,531 | A * | 12/1992 | Broschard et al. | 439/541.5 |
| 6,120,321 | A * | 9/2000 | Wu | 439/541.5 |
| 6,162,089 | A * | 12/2000 | Costello et al. | 439/541.5 |
| 6,165,014 | A * | 12/2000 | Kao et al. | 439/607.01 |
| 6,174,198 | B1 * | 1/2001 | Wu et al. | 439/541.5 |
| 6,238,241 | B1 * | 5/2001 | Zhu et al. | 439/541.5 |
| 6,383,024 | B1 * | 5/2002 | Wang et al. | 439/607.23 |
| 6,419,529 | B1 * | 7/2002 | Shi et al. | 439/701 |
| 6,921,291 | B2 * | 7/2005 | Shih | 439/541.5 |
| 6,997,742 | B1 * | 2/2006 | Tung | 439/541.5 |
| 7,677,923 | B1 * | 3/2010 | Chen et al. | 439/541.5 |
| 2006/0134984 | A1 * | 6/2006 | Korsunsky et al. | 439/607 |
| 2007/0232132 | A1 * | 10/2007 | Ling et al. | 439/541.5 |

FOREIGN PATENT DOCUMENTS

| | | | |
|---|---|---|---|
| CN | 2609207 | Y | 3/2004 |
| CN | 2924850 | Y | 7/2007 |
| CN | 201282235 | Y | 7/2009 |
| TW | 551665 | Y | 9/2003 |
| TW | 555186 | Y | 9/2003 |
| TW | M327589 | | 8/2008 |

* cited by examiner

*Primary Examiner* — Briggitte R Hammond
(74) *Attorney, Agent, or Firm* — Tim Tingkang Xia; Morris, Manning & Martin, LLP

(57) ABSTRACT

This invention discloses a stacked electrical connector including a first connector, a second connector, and a conductive casing. The first connector includes a first signal connection portion and a first group of soldering pins extending along a direction. The second connector includes a second signal connection portion and a second group of soldering pins extending along the direction. The first connector is stacked on the second connector. The conductive casing has a first opening, a second opening, and a third opening. The conductive casing covers the first connector and the second connector. The first signal connection portion passes through the first opening, and the second signal connection portion passes through the second opening. The first group of soldering pins and the second group of soldering pins are exposed to the third opening.

14 Claims, 4 Drawing Sheets

STACKED ELECTRICAL CONNECTOR

CROSS-REFERENCE TO RELATED APPLICATIONS

This Non-provisional application claims priority under 35 U.S.C. §119(a) on Patent Application No(s). 097129797 filed in Taiwan, Republic of China on Aug. 6, 2008, the entire contents of which are hereby incorporated by reference.

BACKGROUND OF THE INVENTION

1. Field of the Invention

The invention relates to a stacked electrical connector and, more particularly, to a stacked electrical connector completely shielded.

2. Description of the Related Art

With the development of electronic science technology, more and more types of peripheral device of a computer are increased. The connection interfaces used by the devices having the same functions have a plurality of specification. Since shapes of a motherboard and a casing for containing the motherboard are limited, it is impossible to independently assemble all the connection interfaces at peripheries of the motherboard. Therefore, there are stacked connectors on the market. However, the present stacked electrical connector just makes separate connectors stacked together, and an area of pins for the motherboard is just a sum of areas of pins of the separate connectors. In addition, since the separate connectors are stacked, more part of signal transmission terminals (pins) is exposed to outside. That is, the signal interference may deteriorate. Particularly, the connector stacked above (away from the motherboard) is greatly affected.

Therefore, the conventional stacked electrical connector just saves a usable and limited periphery for the motherboard, and an area of a corresponding footprint configuration on the motherboard does not decrease in reality, which fails to benefit size decrease of the motherboard.

BRIEF SUMMARY OF THE INVENTION

The objective of this invention is to provide a stacked electrical connector having a complete shielding function and suitable for a smaller area of a footprint configuration.

The invention provides a stacked electrical connector including a first connector, a second connector, and a conductive casing. The first connector includes a first signal connection portion and a first group of soldering pins extending along a direction. The second connector includes a second signal connection portion and a second group of soldering pins extending along the direction. The first connector is stacked on the second connector. The conductive casing has a first opening, a second opening, and a third opening. The conductive casing covers the first connector and the second connector. Thus, the first signal connection portion passes through the first opening, the second signal connection portion passes through the second opening, and the first group of soldering pins and the second group of soldering pins are exposed to the third opening. Thereby, the conductive casing can shield external interference, such that the electrical connector can still reliably transmit signals in the stacked structure.

The stacked electrical connector in an embodiment of the invention is applied to a video graphics array (VGA) connector and a digital visual interface (DVI) connector, and the VGA connector is closer to the third opening than the DVI connector. The soldering pins of the VGA connector may be arranged to two rows instead of conventional three rows, thus to decrease the thickness of the stacked electrical connector. In the embodiment, the whole thickness of the conductive casing vertical to the direction may be less than 12 mm.

Therefore, the stacked electrical connector in an embodiment of the invention has a complete shielding structure capable of effectively preventing electromagnetic interference. Further, by arranging the soldering pins properly, the thickness of the stacked electrical connector decreases, and the needed footprint configuration decreases, which benefits miniaturization of a circuit board connected with the connector.

These and other features, aspects, and advantages of the present invention will become better understood with regard to the following description, appended claims, and accompanying drawings.

DETAILED DESCRIPTION OF THE INVENTION

Figure 1:
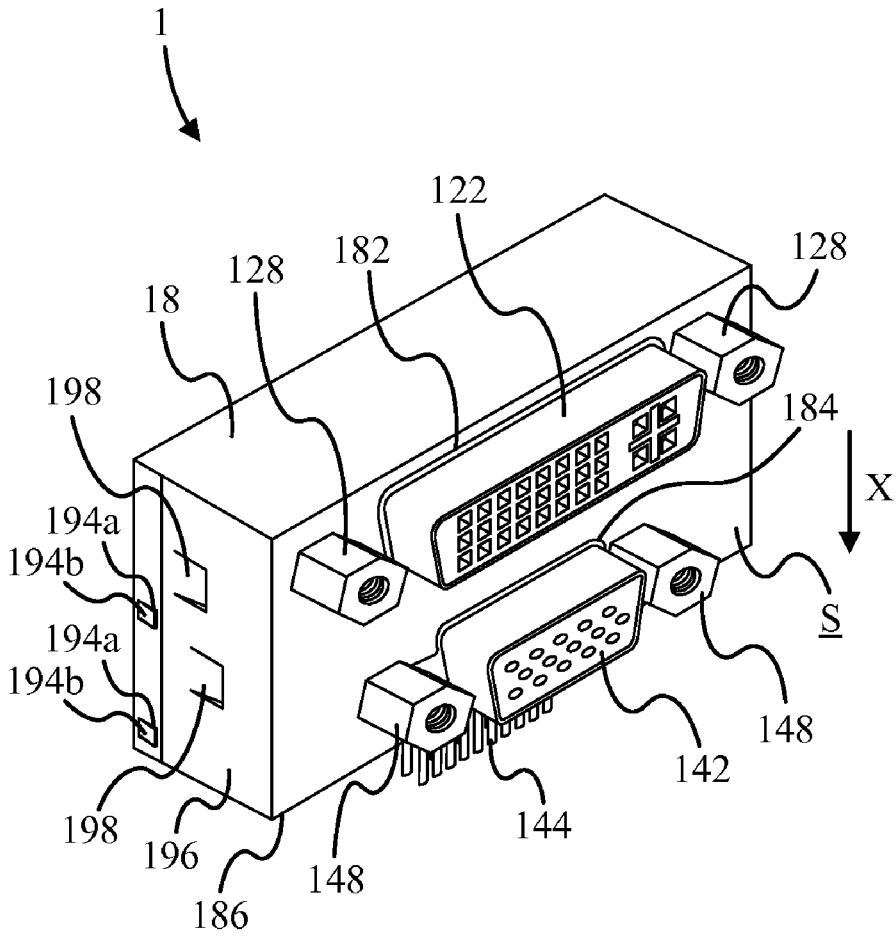
FIG. 1 is a three-dimensional diagram showing a stacked electrical connector according to a preferred embodiment of the invention.
Figure 2:
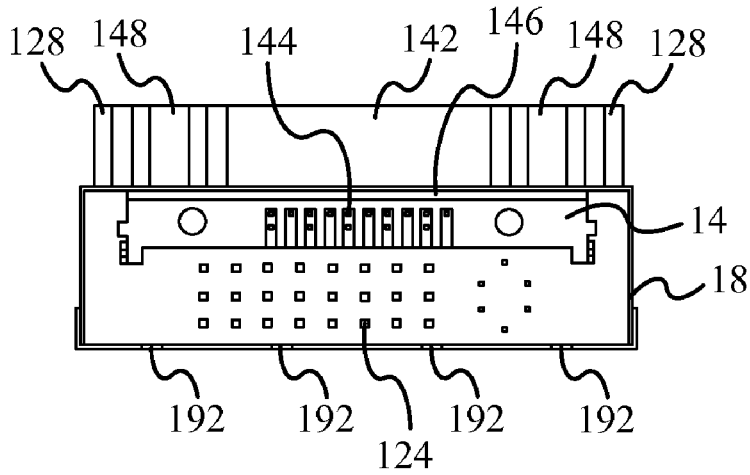
FIG. 2 is a bottom view showing a stacked electrical connector.
Figure 3:
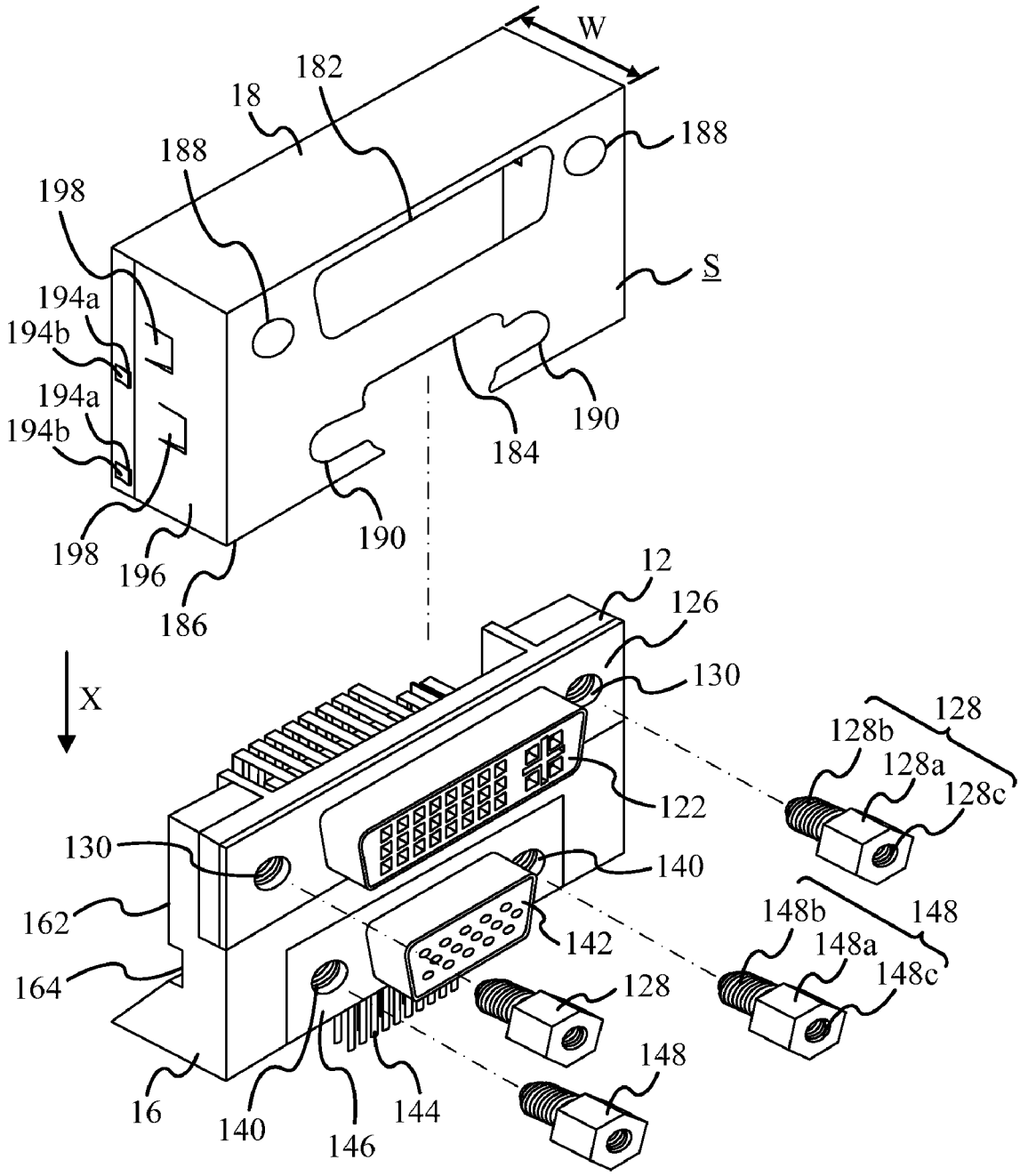
FIG. 3 is an exploded diagram showing part of a stacked electrical connector.

FIG. 1 is a three-dimensional diagram showing a stacked electrical connector 1 according to a preferred embodiment of the invention. FIG. 2 is a bottom view showing the electrical connector 1. FIG. 3 is an exploded diagram showing part of the electrical connector 1. Please refer to FIG. 1, FIG. 2, and FIG. 3. The stacked electrical connector 1 includes a first connector 12, a second connector 14, a frame 16, and a conductive casing 18. The first connector 12 and the second connector 14 are connected with each other via the frame 16. The conductive casing 18 covers the first connector 12, the second connector 14, and the frame 16 at the same time.

The first connector 12 includes a first signal connection portion 122 and a first group of soldering pins 124 (one is marked). The first group of soldering pins 124 extends along a direction X. The second connector 14 includes a second signal connection portion 142 and a second group of soldering pins 144 (one is marked). The second group of soldering pins 144 also extends along the direction X. The conductive casing 18 has a first opening 182, a second opening 184, and a third opening 186, and it has a flat surface S parallel to the direction X. The first opening 182 and the second opening 184 are located at the flat surface S. The first signal connection portion 122 passes through the first opening 182, and a ground casing 126 of the first connector 12 contacts the conductive casing 18. The second signal connection portion 142 passes through the second opening 184, and a ground casing 146 of the second connector 14 also contacts the conductive casing 18. The first group of soldering pins 124 and the second group of soldering pins 144 are exposed to the third opening 186. In addition, the first connector 12 further includes two fastening posts 128 and two screw holes 130 corresponding to the fastening posts 128. The fastening post 128 includes a hexangular post 128*a*, a screw portion 128*b*, and a screw hole 128*c* (as shown in FIG. 3, one is marked). The conductive casing 18 has two fastening holes 188 on the flat surface S corresponding to the screw holes 130 of the first connector 12. By screwing the screw portions 128*b* of the fastening posts 128 into the screw holes 130, the conductive casing 18 can be retained between the ground casing 126 and the hexangular posts 128*a* of the fastening posts 128. The screw holes 128*c* can be used for fastening external connectors.

Similarly, the second connector 14 further includes two fastening posts 148 and two screw holes 140 corresponding to the fastening posts 148. The fastening post 148 includes a hexangular post 148*a*, a screw portion 148*b*, and a screw hole 148*c* (as shown in FIG. 3, one is marked). The conductive casing 18 has two fastening holes 190 on the flat surface S corresponding to the screw holes 140 of the second connector 14. By screwing the screw portions 148*b* of the fastening posts 148 into the screw holes 140, the conductive casing 18 can be retained between the ground casing 146 and the hexangular posts 148*a* of the fastening posts 148. Further, the screw holes 148*c* can be used for fastening external connectors. The difference between the fastening holes 190 and the fastening holes 188 described above is that the fastening holes 188 are formed independently, while the fastening holes 190 are formed with the second opening 184. However, the invention is not limited thereto. It can be determined by practical design needs.

The outline of the first opening 182 matches the first signal connection portion 122, and the outline of the second opening 184 matches the second signal connection portion 124. Thereby, the conductive casing 18 can be attached to the first connector 12 and the second connector 14 to realize a complete cover, thereby providing a complete shielding function. In the preferred embodiment of the invention, without the conductive casing 18, under the external signal frequency from 115 MHz to 667 MHz, the stacked electrical connector 1 may suffer electromagnetic interference above than 10 dB. The highest electromagnetic interference suffered by the stacked electrical connector 1 having the conductive casing 18 under the same external signal frequency (even reaching to 983 MHz) is −2.6 dB. Apparently, the stacked electrical connector 1 in the embodiment of the invention can effectively solve the serious electromagnetic interference of the stacked electrical connector.

Figure 4:
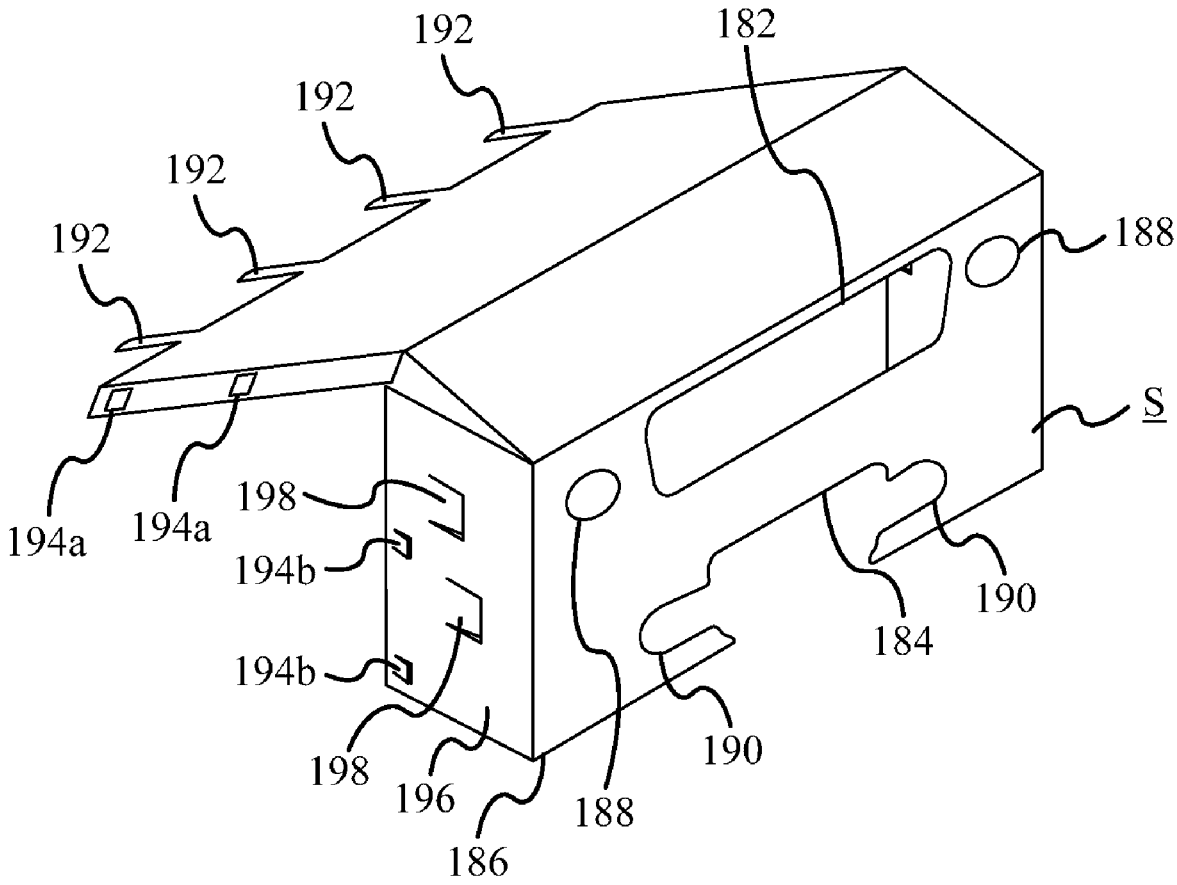
FIG. 4 is a schematic diagram showing a conductive casing partly unfolded.

Please refer to FIG. 3 and FIG. 4. FIG. 4 is a schematic diagram showing the conductive casing 18 partly unfolded. According to the preferred embodiment of the invention, the conductive casing 18 is integrally formed and includes a plurality of ground soldering pins 192 for being soldered on a ground circuit of a circuit board to provide a shielding function. The conductive casing 18 includes a plurality of retaining holes 194*a* and corresponding elastic elements 194*b*. When the conductive casing 18 is bent, the retaining holes 194*a* retain the corresponding elastic elements 194*b* to form a stable shielding casing. Based on the similar reason, the conductive casing 18 further includes a plurality of elastic elements 198 extending from a side wall 196 of the conductive casing 18 toward the first opening 182 (that is, the second opening 184 or the flat surface S). After the conductive casing 18 and the frame 16 are assembled, the side wall 162 or an indentation opening 164 of the frame 16 can retain the elastic elements 198, thereby fastening the conductive casing 18 to the frame 16 (even the first connector 12 or the second connector 14). FIG. 3 is not an assembling schematic diagram exactly showing the stacked electrical connector 1. In other words, before the conductive casing 18 in FIG. 3 is assembled to the first connector 12 and the second connector 14, the conductive casing 18 is unfolded as shown in FIG. 4. After the first opening 182 and the second opening 184 are sleeved on the first signal connection portion 122 and the second signal connection portion 142, respectively, the retaining holes 194*a* and the elastic elements 194*b* are retained to form an appearance as shown in FIG. 1.

According to the preferred embodiment of the invention, the first connector 12 is a digital visual interface (DVI) connector, and the second connector 14 is a video graphics array (VGA0 connector. Please refer to FIG. 1 and FIG. 2. The second signal connection portion 142 of the second connector 14 includes 15 signal connection points arranged in three rows and electrically connected with the second group of soldering pins 144, respectively. The second group of soldering pins 144 is arranged in two rows different from three rows in the prior art. Thereby, the footprint area on the circuit board needed by the second group of soldering pins 144 decreases.

Figure 5:
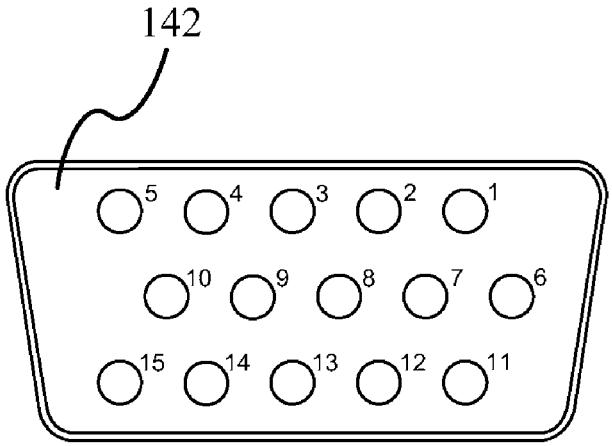
FIG. 5 is a front view showing a second signal connection portion having connection points marked.
Figure 6:
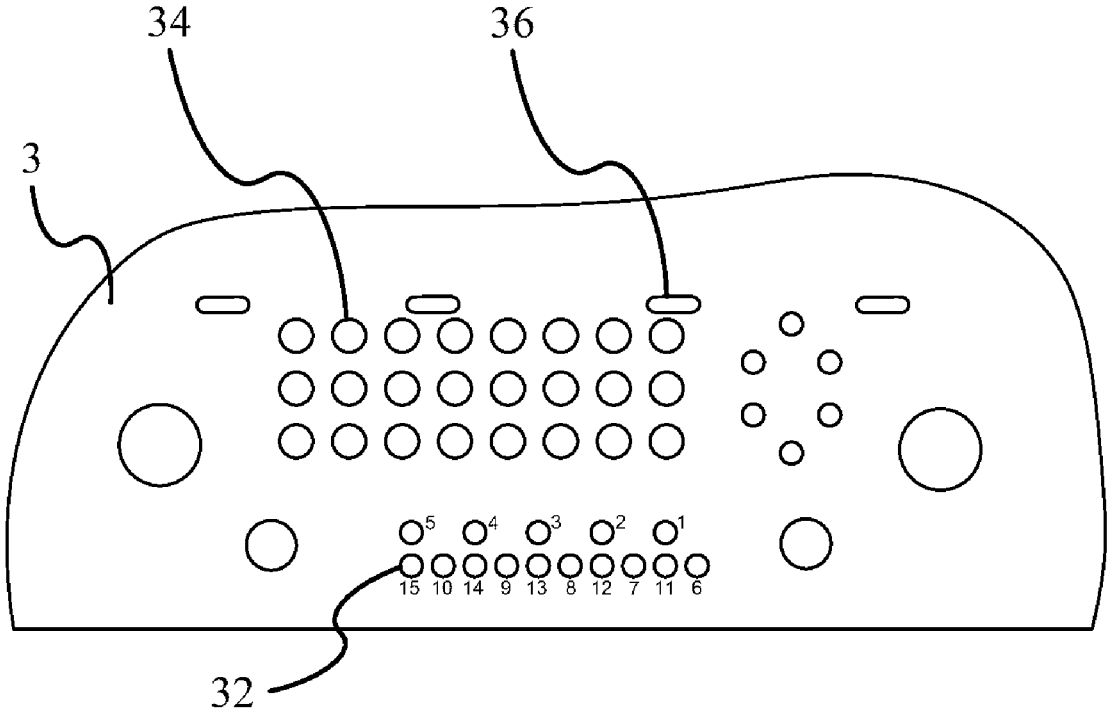
FIG. 6 is a schematic diagram showing a footprint configuration of a circuit board suitable for a stacked electrical connector.

Please refer to FIG. 5 and FIG. 6. FIG. 5 is a front view showing the second signal connection portion 142 having the connection points marked. FIG. 6 is a schematic diagram showing a footprint configuration of a circuit board 3 suitable for the stacked electrical connector 1. The circuit board 3 forms fifteen holes 32 for the second group of soldering pins 144, thirty holes 34 for the first group of soldering pins 124, and four holes 36 for the ground soldering pins 192 (only one is marked). In FIG. 6, the connection points corresponding to the holes 32 are marked to show the corresponding relation of each connection point and each hole 32 of the circuit board 3 via the second group of soldering pins 144. The holes 32 are arranged in two rows.

The first row of the connection points of the second signal connection portion 142 (the connection points marked from 1 to 5) corresponds to a first row of the holes 32 of the circuit board 3. The second row and the third row of the connection points (the connection points marked from 6 to 15) interlacingly correspond to a second row of the holes 32 of the circuit board 3. In other words, the second row (five soldering pins) of the second group of soldering pins 144 in FIG. 2 corresponds to the first row of the holes 32 of the circuit board 3. The first row (ten soldering pins) of the second group of soldering pins 144 corresponds to the second row of the holes 32 of the circuit board 3. Further, a central distance between two adjacent soldering pins of the second row of the second group of soldering pins 144 is approximately 1.14 mm. That is, a central distance between two adjacent soldering pins of the second row of the holes 32 of the circuit board 3, such as the holes 32 with the reference marks 7 and 11, is approximately 1.14 mm.

In another embodiment of the invention different from the above embodiment, the second group of soldering pins 144 electrically connected to the first and second row of the connection points of the second signal connection portion 142 (the connection points marked from 1 to 10) is integrated into one row. The second group of soldering pins 144 electrically connected to the third row of the connection points of the second signal connection portion 142 (the connection points marked from 11 to 15) directly forms another row. At that moment, the holes 32 of the circuit board 3 need to be correspondingly disposed. From the above, in the embodiment of the invention, the second group of soldering pins 144 corresponding to two adjacent rows of the connection points can be easily integrated into one row in a direct interlaced mode, thereby decreasing the area of the footprint configuration needed by the second group of soldering pins 144. Since the second group of soldering pins 144 is not averagely rearranged into two rows as a whole to correspond to the signal connection points (three rows), the manufacturing problem of the second connector 14 and the wiring problem of the circuit board 3 can be avoided.

Since the second connector 14 of the stacked electrical connector 1 needs a smaller footprint area, the stacked electrical connector 1 (or the conductive casing 18) has a thickness less than 12 mm along a direction vertical to the flat surface S (as shown in FIG. 3, a reference mark W).

To sum up, the stacked electrical connector in the invention has a complete shielding structure capable of effectively solving the serious electromagnetic interference caused by the stacked electrical connector. Further, by arranging the soldering pins to make them interlacingly correspond to the adjacent two rows of the signal connection points, the thickness of the stacked electrical connector decreases, and the needed footprint configuration decreases, which benefits miniaturization of a circuit board connected with the connector.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A stacked electrical connector comprising:

a first connector comprising a first signal connection portion and a first group of soldering pins, the first group of soldering pins extending along a direction;

a second connector comprising a second signal connection portion and a second group of soldering pins, the second group of soldering pins extending along the direction, and the first connector stacked on the second connector; and a conductive casing having a first opening, a second opening, and a third opening, and an elastic element, the conductive casing covering the first connector and the second connector, the first signal connector portion passing through the first opening, the second signal connection portion passing through the second opening, and the first group of soldering pins and the second group of soldering pins exposed to the third opening; and a frame retaining the elastic element, the first connector connected with the second connector via the frame.

2. The stacked electrical connector according to claim 1, wherein the first connector comprises a ground casing contacting the conductive casing.

3. The stacked electrical connector according to claim 1, wherein the conductive casing has a fastening hole adjacent to the first opening, the first connector comprises a fastening post, and the fastening post passes through the fastening hole to fasten the conductive casing to the first connector.

4. The stacked electrical connector according to claim 1, wherein an outline of the first opening matches the first signal connection portion, and an outline of the second opening matches the second signal connection portion.

5. The stacked electrical connector according to claim 1, wherein the conductive casing is integrally formed.

6. The stacked electrical connector according to claim 1, wherein the conductive casing comprises a ground soldering pin.

7. The stacked electrical connector according to claim 1, wherein the elastic element is toward the first opening from a side wall of the conductive casing and extends inwards.

8. The stacked electrical connector according to claim 1, wherein the conductive casing has a flat surface parallel to the direction, and the first opening and the second opening are located at the flat surface.

9. The stacked electrical connector according to claim 8, wherein the second connector is a video graphics array (VGA) connector.

10. The stacked electrical connector according to claim 9, wherein the second connector is located between the first connector and the third opening, the second signal connection portion comprises a plurality of signal connection points arranged in three rows, and the second group of soldering pins is electrically connected with the signal connection points and arranged in two rows.

11. The stacked electrical connector according to claim 10, wherein a central distance between two adjacent soldering pins in a row of the second group of soldering pins is essentially 1.14 mm.

12. The stacked electrical connector according to claim 10, wherein two adjacent rows of the connection points of the second signal connection portion are electrically connected with a row of the second group of soldering pins.

13. The stacked electrical connector according to claim 9, wherein the first connector is a digital visual interface (DVI) connector.

14. The stacked electrical connector according to claim 13, wherein the conductive casing has a whole thickness less than 12 mm along a direction vertical to the flat surface.

* * * * *